US005970296A

United States Patent [19]

Takase

[11] Patent Number: 5,970,296

[45] Date of Patent: Oct. 19, 1999

[54] IMAGE FORMING APPARATUS

[75] Inventor: Makoto Takase, Okazaki, Japan

[73] Assignee: Minolta Co., Ltd., Osaka, Japan

[21] Appl. No.: 09/165,344

[22] Filed: Oct. 2, 1998

[30] Foreign Application Priority Data

Oct. 6, 1997 [JP] Japan ..... 9-272327

[51] Int. Cl.[6] ..... G03G 15/16

[52] U.S. Cl. ..... 399/310; 399/303; 399/314; 399/389

[58] Field of Search ..... 399/312, 314, 399/303, 310, 299, 306, 389

[56] References Cited

U.S. PATENT DOCUMENTS

| | | | |
|---|---|---|---|
| 4,984,024 | 1/1991 | Ohkaji et al. . | |
| 5,119,139 | 6/1992 | Torisawa . | |
| 5,337,136 | 8/1994 | Knapp et al. . | |
| 5,455,663 | 10/1995 | Inoue et al. . | |
| 5,631,725 | 5/1997 | Harasawa et al. | 399/66 |
| 5,794,110 | 8/1998 | Kasai et al. | 399/299 |

OTHER PUBLICATIONS

"Elastic Semiconductor Belt Transfer System", Akira Kumon and Masaichirou Tatekawa, pp. 1–15 (Feb. 10, 1994) and English translation thereof.

*Primary Examiner*—Richard Moses
*Attorney, Agent, or Firm*—McDermott, Will & Emery

[57] ABSTRACT

An object of the present invention is to provide an image forming apparatus which prevents transfer memory from occurring and achieves a desired potential of an image carrier (photosensitive body) when forming an image in next cycle, thereby to obtain a high-quality output image.

In order to achieve the object described above, the image forming apparatus of the invention has a belt grounding device 21 which makes contact with a transfer belt 5 and is capable of switching between grounded state and ungrounded state according to the size of copy paper P. With this configuration, because only a portion not covered by the copy paper P can be grounded according the size of the copy paper P, excessive current can be prevented from flowing into a photosensitive drum 1 at this portion, thereby preventing transfer memory from occurring.

23 Claims, 10 Drawing Sheets

IMAGE FORMING APPARATUS

This application is based on application No.H9-272327 filed in Japan, the content of which is hereby incorporated by reference.

BACKGROUND OF THE INVENTION

1. Field of the Invention

The present invention relates to an image forming apparatus based on electrophotography for obtaining an output image by transferring a toner image held on an image carrier onto a transfer material, and particularly to an image forming apparatus which prevents transfer memory from taking place due to different sizes of the transfer materials.

2. Description of the Related Art

In an image forming apparatus of the prior art, a transfer material carrier holding a transfer material thereon is moved to a transferring position where a toner image held by an image carrier is transferred onto the transfer material thereby to obtain an output image. For this type of image forming apparatus, such a configuration has been known as a belt or a cylindrical drum is used as the transfer material carrier and a transfer charger of contact type or non-contact type is arranged on the inner surface of the belt or the cylindrical drum for transferring the toner image held by the image carrier onto the transfer material.

An example of such an image forming apparatus of belt transfer type utilizing a transfer belt is described in the Journal of Electrophotography Association vol. 33, No. 1 (1994). Constitution of this image forming apparatus will be described below with reference to FIG. 18. The image forming apparatus has, around a photosensitive drum 101 which has an electrostatic latent image formed thereon by scanning exposure and is located at the center, an electrostatic charger 102 for charging the surface of the photosensitive drum 101 with electrostatic charges, a developer 104 which develops the electrostatic latent image by means of toner, an image transfer corona discharger 116 and a transfer belt 105 for transferring the toner image formed through development onto copy paper P, a cleaner 106 which cleans the photosensitive drum 101 upon completion of one imaging cycle, an eraser 107 which removes the electrostatic charge from the surface of the photosensitive drum 101, and other components.

The transfer belt 105, which comes into proximity to the photosensitive drum 101 at a transferring position and is driven to run in synchronization with the rotation of the photosensitive drum 101, is stretched across three metal rollers, namely a drive roller 118, a driven roller 119 and a pre-transfer roller 121. The pre-transfer roller 121, which makes contact with the transfer belt 105 immediately before the transferring position, is grounded thereby to allow the electrostatic charge to collectively flow into the earth and prevent the potential from building up, for the purpose of preventing 'premature scatter' from taking place which is such a phenomenon as the toner moves through a narrow space between the photosensitive drum 101 and the transfer belt 105. The pre-transfer roller 121 has another purpose of assisting in the discharge of the image transfer corona discharger 116. Installed around the transfer belt 105 is a belt cleaner 120 which cleans the outer surface of the transfer belt 105 by means of a blade making contact with the transfer belt 105. The pre-transfer roller 121 may be omitted.

In the image forming apparatus constituted as described above, an output image is obtained through such operations as described below. First, copy paper P (transfer material) fed out by a paper feed roller from a paper tray is, after being synchronized with the photosensitive drum 101 by the timing roller 109, sent onto the transfer belt 105 and is then sent to a transfer section by the transfer belt 105. At this time, because the transfer belt 105 is supplied with electric charge by the image transfer corona discharger 116, the copy paper P experiences electrostatic polarization due to an external electric field generated by the charge. When the copy paper P reaches the transferring position between the photosensitive drum 101 and the transfer belt 105, the toner is transferred onto the copy paper P. As the pre-transfer roller 121 is brought into contact with the transfer belt 105 immediately before the transferring position, 'premature scatter' of the toner held on the photosensitive drum 101 moving through a narrow space between the photosensitive drum 101 and the transfer belt 105 is prevented from taking place, thereby ensuring reliable transfer of the toner onto the copy paper P. Then the copy paper P is moved by the transfer belt 105 to a fixing section, where the toner is fixed by a fixing roller 108 thereby to obtain the output image.

OBJECTS AND SUMMARY

However, the image forming apparatus of the prior art described above has problems as described below. That is, a new electric circuit is formed in the direction of grounding via the transfer belt 105, thereby causing a portion occupied by the copy paper P to have higher impedance than that of a portion without the copy paper P. Also only one voltage can be set for the image transfer corona discharger 116, and therefore the same voltage is applied to the portion without the copy paper P as that applied to the portion occupied by the copy paper P. Consequently, an excessive current flows into the photosensitive drum 101 at the portion without the copy paper P which has lower impedance. When this happens, the photosensitive drum 101 cannot attain the required potential in the portion without the copy paper P in the next cycle of image forming. More specifically, when a copy paper sheet P of larger size is passed after passing a copy paper sheet P of small size, for example, potential of the photosensitive drum 101 does not reach the required level in a portion outside the copy paper sheet P of small size (a region where the copy paper P does not exist when transferring an image onto a small paper sheet P), which results in image noise called transfer memory, which leads to imaging defects such as excessive toner concentration of the image, thickened lines of letters and fogging of portions which should remain white. In case the copy paper P is fed at an angle from the feeding direction, such a trouble may occur as toner sticks onto the copy paper P along one edge thereof.

In an apparatus where the pre-transfer roller 121 is omitted, voltage of the image transfer corona discharger 116 can be set lower than that in an apparatus equipped with the pre-transfer roller 121. However, the problem that the portion occupied by the copy paper P has a higher impedance than the portion without the copy paper P persists also in this apparatus, resulting in an excessive current flowing into the photosensitive drum 101 at the portion without the copy paper P. Consequently, transfer memory takes place in this portion, thus leading to imaging defects such as excessive toner concentration of the image, thickened lines of letters and fogging of portions which should remain white.

The present invention has been made in order to solve the problems described above, and it is an object of the invention to provide an image forming apparatus which is capable of obtaining a high quality output image by preventing transfer memory from taking place and thereby attaining a desired potential of an image carrier (photosensitive body) in the next image forming cycle.

In order to solve the problems described above, one aspect of the invention provides an image forming apparatus having an image carrier which holds a toner image, a transfer material carrier which carries a transfer material to a transferring position, and an image transfer field forming means which forms transfer electric field at the transferring position for transferring the toner image held on the image carrier onto the transfer material, wherein the image forming apparatus is provided with an electrically conductive member which makes contact with the transfer material carrier and is capable of switching between grounded state and ungrounded state, while the electrically conductive member comprises a plurality of pieces separated in the direction of width of the transfer material carrier.

BRIEF DESCRIPTION OF THE DRAWINGS

These and other objects and features of the present invention will become apparent from the following description of a preferred embodiments thereof taken in conjunction with the accompanying drawings, in which.

In the following description, like parts are designated by like reference numbers throughout the several drawings.

DETAILED DESCRIPTION OF THE PREFERRED EMBODIMENT

Figure 1:
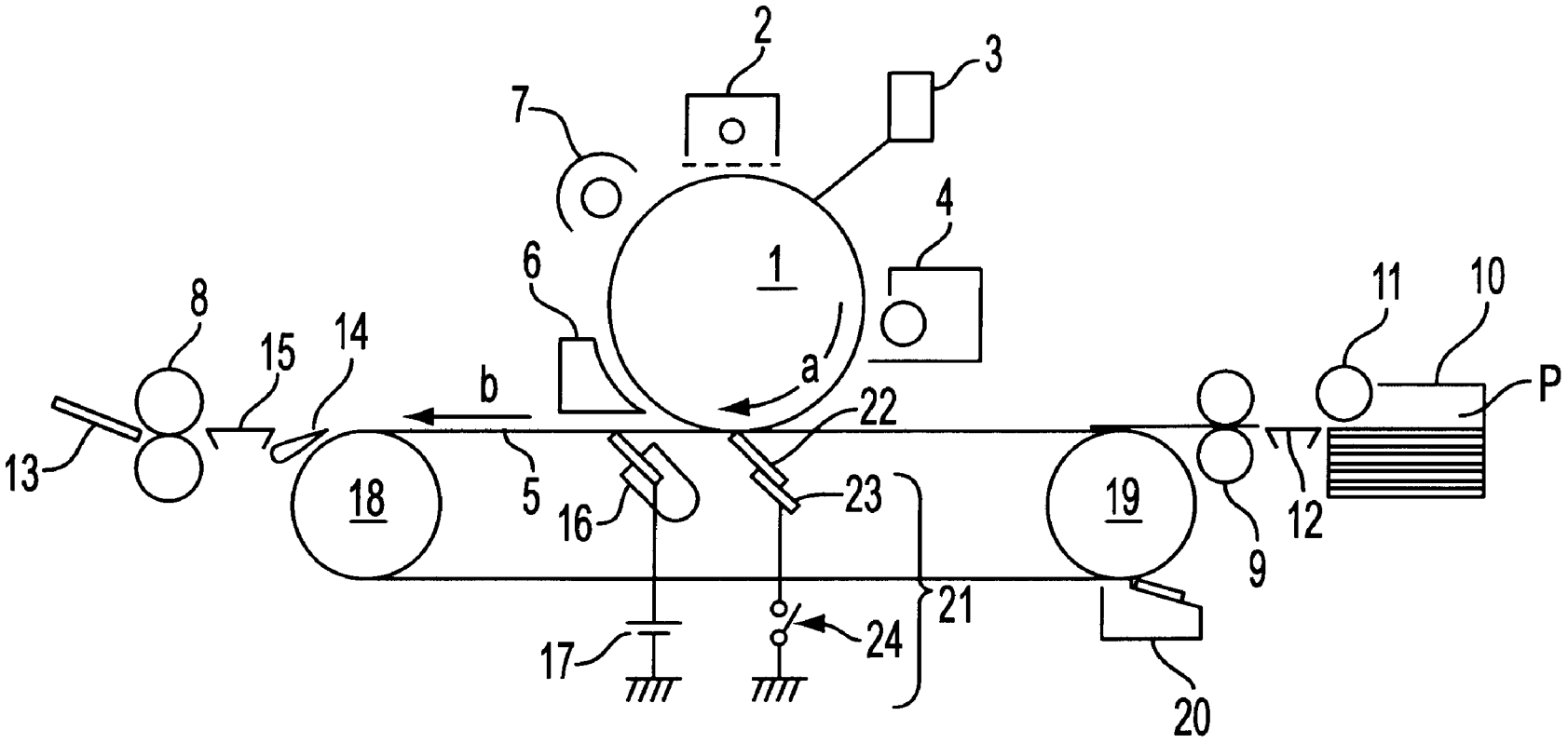
FIG. 1 is a schematic drawing showing the configuration of a key portion of a copying machine wherein the invention is applied.

As described previously, transfer memory occurs when an excessive current flows into an image carrier (photosensitive body) in a portion without transfer material during transfer operation, making it impossible to attain the required potential of the image carrier in the next cycle of image forming. This means that transfer memory can be prevented from occurring by preventing the excessive current from flowing into the image carrier.

Therefore according to the first embodiment, the electrically conductive member comprises a plurality of pieces separated in the direction of width of the transfer material carrier. And only a desired number of pieces can be brought into contact with the transfer material carrier or out of contact therewith. Thus only a portion where there is no transfer material during transfer operation can be grounded by means of the electrically conductive member. Accordingly, a new electric circuit having a low impedance for current bypass is formed in the portion without the transfer material. And the excessive current which would flow into the image carrier in the portion without the transfer material is diverted to the current bypass electric circuit. Thus the excessive current can be prevented from flowing into the image carrier in the portion without transfer material. This makes it possible to prevent transfer memory from occurring and to obtain high-quality output image.

The second embodiment aimed at solving the problems described above is the image forming apparatus of the first embodiment wherein the pieces are held in a state of being insulated from each other.

According to the second embodiment, the pieces constituting the electrically conductive member are held in a state of being insulated from each other. Therefore, a desired number of the pieces can be selected and grounded while the electrically conductive member is kept in contact with the transfer material carrier. That is, only the portion where there is no transfer material during transfer operation can be grounded by means of the electrically conductive member. Thus an electric circuit for current bypass is formed, which prevents an excessive current from flowing into the image carrier at this portion. Consequently, transfer memory can be prevented from occurring.

The third embodiment aimed at solving the problems described above is the image forming apparatus of the first embodiment or the second embodiment wherein a selector switch for switching the electrically conductive member between grounded state and ungrounded state is provided for each piece.

According to the third embodiment, grounded state and ungrounded state of the electrically conductive member can be switched by means of the selector switch provided for each piece. That is, only the portion without the transfer material can easily be grounded by means of the switch during transfer operation. Since this causes an electric circuit for current bypass to be formed, excessive current can be prevented from flowing into the image carrier at this portion. Consequently, transfer memory can be prevented from occurring.

The fourth embodiment aimed at solving the problems described above is the image forming apparatus of the third embodiment wherein only a portion where there is no transfer material can be grounded by switching the selector switch according to the size of the transfer material.

According to the fourth embodiment, the selector switch is switched according to the size of the transfer material. Specifically, only a portion where there is no transfer material during transfer operation can be surely grounded according to the size of the transfer material. Since this causes an electric circuit for current bypass to be formed, excessive current can be prevented from flowing into the image carrier at the portion. Consequently, transfer memory can be accurately prevented from occurring.

The fifth embodiment aimed at solving the problems described above is the image forming apparatus of one of the first embodiment through the fourth embodiment, wherein a position where the electrically conductive member makes contact with the transfer material carrier is located between the position of the image transfer electric field forming means and the transferring position.

According to the fifth embodiment, the electrically conductive member is located between the setting position of the image transfer electric field forming means and the transferring position. Specifically, the electrically conductive member makes contact with the transfer material carrier at a position nearer to just below the image carrier than the image transfer field forming means. This makes it possible to surely form a current bypass circuit in the electric circuit which is formed in the direction from the image transfer electric field forming means toward the imager carrier. And an electric circuit for current bypass can be formed in the portion without the transfer material by grounding only the portion, where there is no transfer material during transfer operation, by means of the electrically conductive member. Thus since excessive current can be prevented from flowing into the image carrier at this portion, transfer memory can be prevented from occurring.

Now the preferred embodiments of the image forming apparatus according to the present invention will be described below in more detail with reference to the accompanying drawings. This embodiment is an image forming apparatus for a copying machine based on electrophotography. A schematic drawing showing the configuration of a key portion of the copying machine is shown in FIG. 1, and the configuration thereof will be described below.

The image forming apparatus is made in such a configuration that has at the center thereof a photosensitive drum 1 where an electrostatic latent image is formed on the surface thereof by scanning exposure. Installed around the photosensitive drum 1 are an electrostatic charger 2 for charging the surface of the photosensitive drum 1 with electrostatic charge, a print head 3 which forms the electrostatic latent image on the photosensitive drum 1 by exposure, a developer 4 which develops the electrostatic latent image by means of a toner, a transfer belt 5 for transferring copy paper P, a cleaner 6 which cleans the photosensitive drum 1 upon completion of one imaging cycle, an eraser 7 which removes the electrostatic charge from the surface of the photosensitive drum 1, and other components.

The transfer belt 5 is a film belt made of PVDF (polyvinylidene fluoride), PC (polycarbonate) or the like or a rubber belt made of CR rubber, urethane rubber or the like. The transfer belt 5 is also electrically semi-conductive, with the ingredients composition thereof being adjusted to have a desired resistivity. The transfer belt 5 is stretched by a drive roller 18 and a driven roller 19, thereby to run in the direction of arrow b in synchronization with the rotation of the photosensitive drum 1 in the direction of arrow a.

Installed around the transfer belt 5 are a transfer brush 16 consisting of an electrically conductive brush for transferring a toner image from the photosensitive drum 1 onto copy paper P placed on the transfer belt 5, a DC power source 17 connected to the transfer brush 16, a belt grounding device 21 (to be described in detail later) provided for the prevention of transfer memory, a separation claw 14 for separating the copy paper P from the transfer belt 5 and a belt cleaner 20 for cleaning the outer surface of the transfer belt 5. The transfer brush 16 and the belt grounding device 21 are both arranged to make contact with the inner surface of the transfer belt 5.

Figure 5:
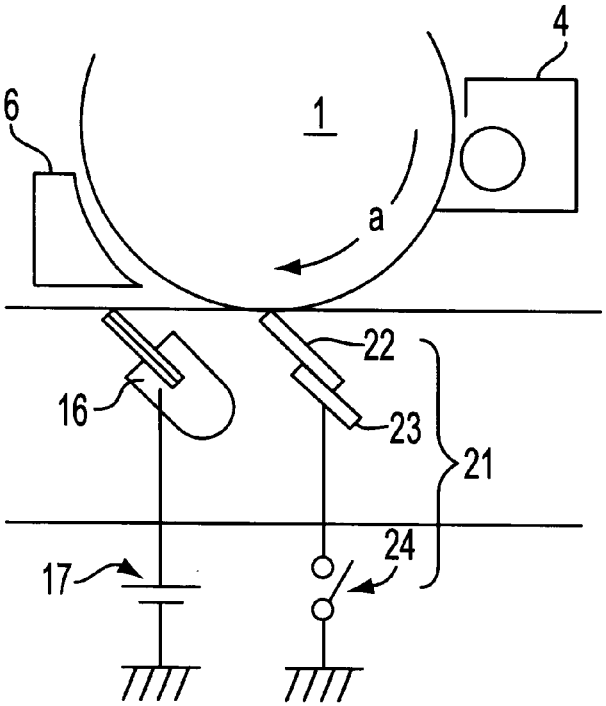
FIG. 5 is an enlarged view of a portion around a transferring position of FIG. 1.
Figure 6:
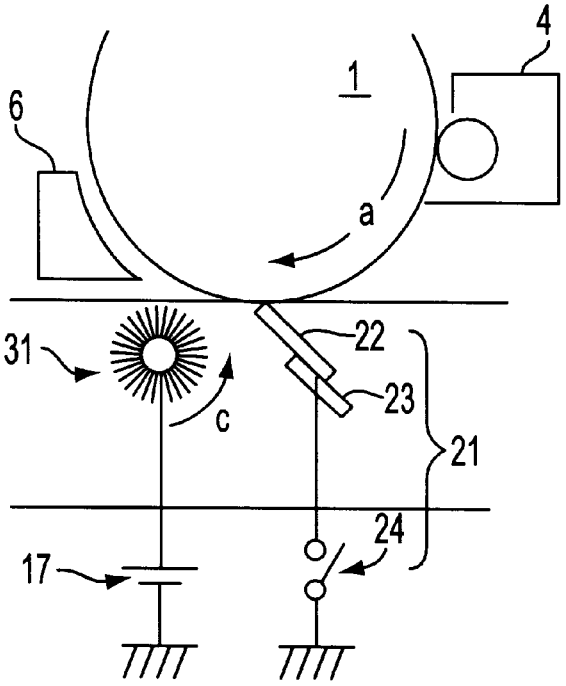
FIG. 6 shows a case where a transfer brush is used as image transfer electric field forming means.
Figure 7:
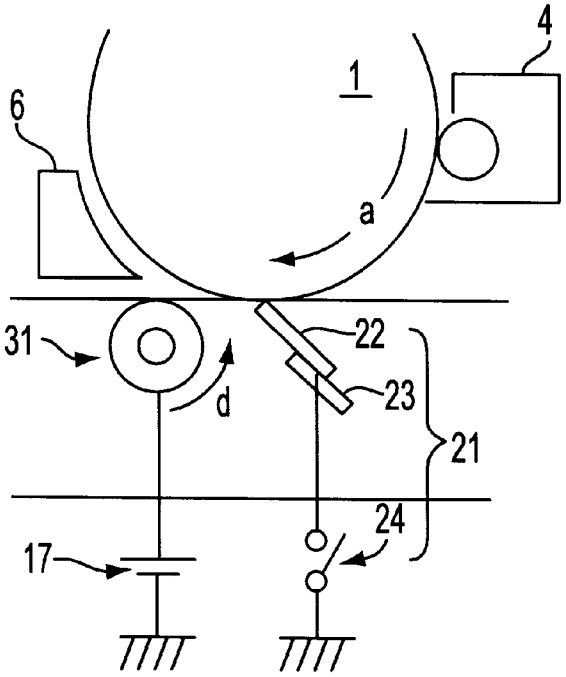
FIG. 7 shows a case where an elastic roller is used as the image transfer field forming means.
Figure 8:
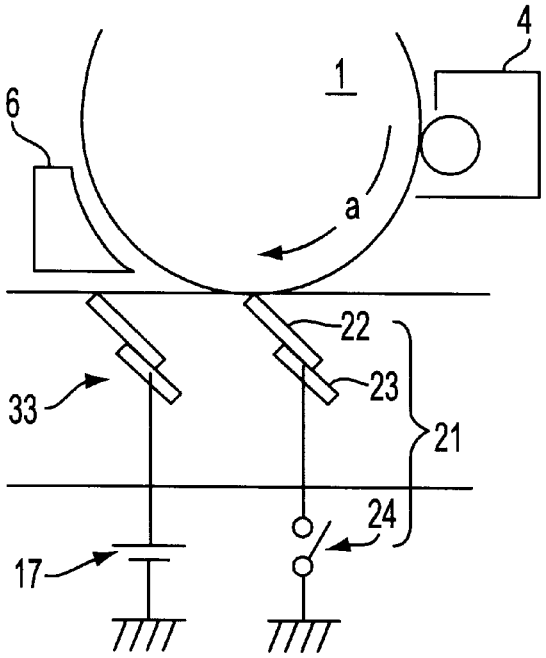
FIG. 8 shows a case where an elastic blade is used as the image transfer field forming means.
Figure 9:
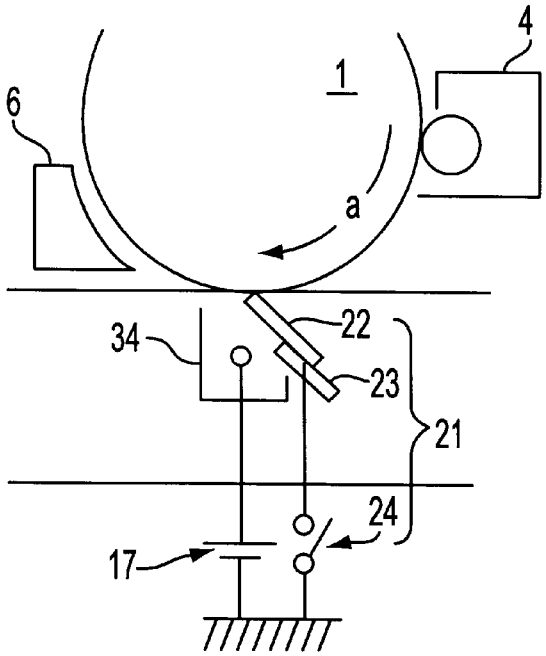
FIG. 9 shows a case where an image transfer corona discharger is used as the image transfer field forming means.
Figure 10:
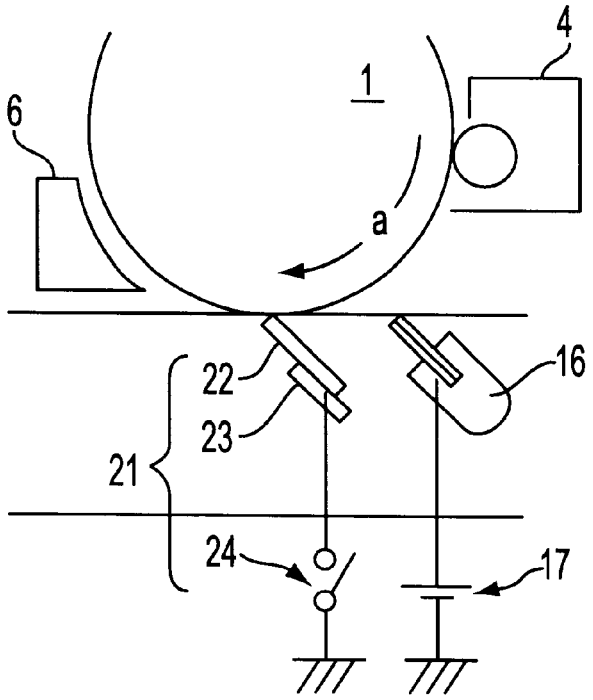
FIG. 10 shows a case where positional relationship of the transfer brush and the belt grounding device is changed.

In the image forming apparatus of FIG. 1, the transfer brush 16 of fixed type is used as the image transfer electric field forming means, but alternatively a rotary brush 31, an elastic roller 32, an elastic blade 33 or an image transfer corona discharger 34 may also be used as shown in FIGS. 6 through 9. FIG. 5 is an enlarged view of the transfer section of FIG. 1, and arrows c, d in FIG. 6 and FIG. 7 indicate the rotating directions of the rotary brush 31 and the elastic roller 32, respectively. Although such a positional relationship between the image transfer electric field forming means (transfer belt 16) and the belt grounding device 21 is required as the belt grounding device 21 is located nearer to just below the photosensitive drum 1 than the transfer brush 16 as shown in FIG. 5, the positional relationship is not limited to that shown in FIG. 5 as far as this relation is satisfied, and such a positional relationship as shown in FIG. 10 may also be employed where both the transfer brush 16 and the belt grounding device 21 are located upstream (at the right in the drawing) from the point just below the photosensitive drum 1.

The image forming apparatus configured as described above operates as follows. First, the copy paper P fed out from a paper tray 10 by a paper feed roller 11 is guided onto a timing roller 9 by a guide 12 and is, after being synchronized with the photosensitive drum 1 by the timing roller 9, moved onto the transfer belt 5 which sends the copy paper P to the transfer section. The photosensitive drum 1, which is rotating in the direction of arrow a of FIG. 1, is charged uniformly on the surface thereof by the electrostatic charger 2 and is subject to scanning exposure to laser light by the printer head 3. The exposure causes the electrostatic latent image to be formed on the photosensitive drum 1, while the electrostatic latent image is then developed by the developer 4 with a toner image being formed thereon.

When the copy paper P reaches the transferring position between the photosensitive drum 1 and the transfer belt 5, the transfer brush 16 located inside the transfer belt 5 supplies electrostatic charge to the transfer belt 5, so that the toner image formed on the photosensitive drum 1 is transferred onto the copy paper P by an electrostatic attractive force. The copy paper P which has received the toner image transferred thereon is attracted onto the transfer belt 5 and carried thereby to the separation claw 14 which separates the copy paper P from the transfer belt 5. The copy paper P separated from the transfer belt 5 is guided to the fixing section by the guide 15 where the toner is fixed by the fixing roller 8, and is then discharged onto a paper discharge tray 13.

Figure 2:
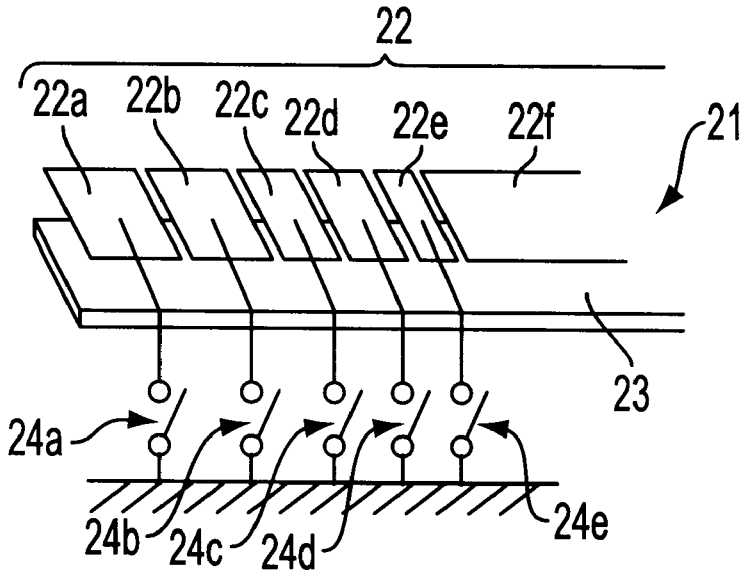
FIG. 2 is a schematic drawing showing the configuration of a belt grounding device.

Now the belt grounding device 21 installed upstream of the transfer brush 16, which is a characteristic section of the invention, will be described in detail below with reference to the accompanying drawings. FIG. 2 schematically shows the belt grounding device 21. The belt grounding device 21 comprises a plurality of separated electrically conductive films 22 bonded onto a holder 23 made of an electrically insulating material such as a resin. The electrically conductive films 22*a*, 22*b*, 22*c*, and so on are connected to switches 24*a*, 24*b*, 24*c*, and so on, respectively, so that each electrically conductive film can be switched between grounded state and ungrounded state. As the electrically conductive films 22 are insulated from each other and a switch 24 is connected to each of the electrically conductive films 22, only a desired portion of the photosensitive drum 1 can be grounded while the electrically conductive films 22 are kept in contact with the transfer belt 5. A method for switching between the grounded state and ungrounded states of the electrically conductive films 22*a*, 22*b*, 22*c* and so on will be described later.

Figure 3:
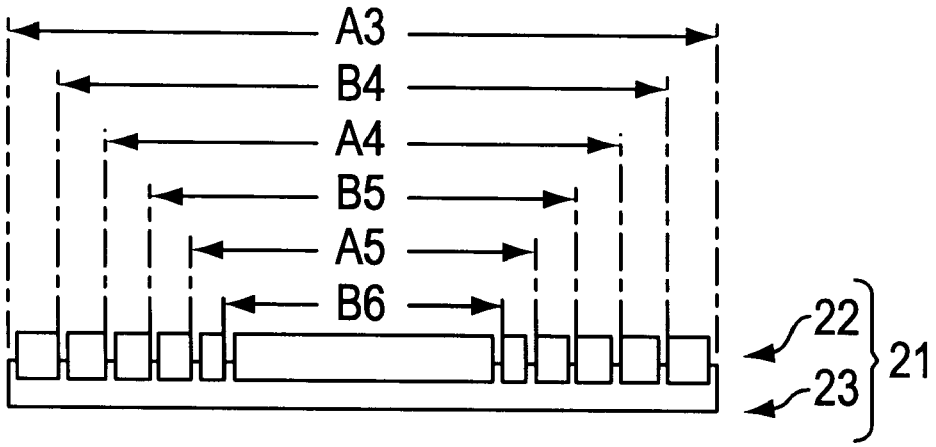
FIG. 3 shows a position of dividing an electrically conductive film.
Figure 4:
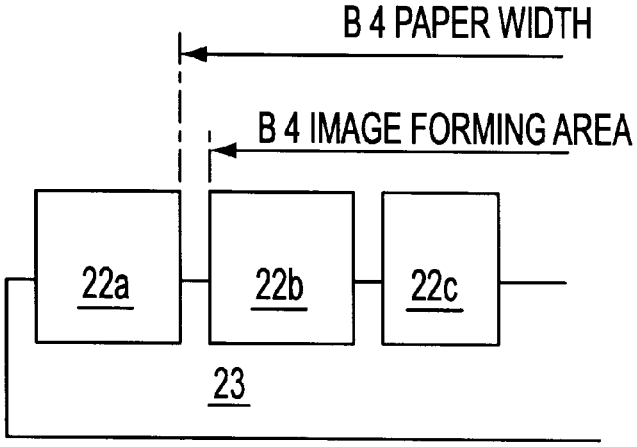
FIG. 4 shows a position of dividing an electrically conductive film in more detail, by enlarging a portion of FIG. 3.

Now division of the electrically conductive film 22 will be described with reference to FIG. 3 and FIG. 4. FIG. 3 and FIG. 4 show the positions where the electrically conductive film is divided. As shown in FIG. 3, the electrically conductive film 22 is divided in a configuration that corresponds to the paper size. Specifically, as shown in FIG. 4, adjacent electrically conductive films 22*a* and 22*b* are arranged in such a positional relationship as an inner edge of the electrically conductive film 22*a* corresponds to the width of the paper (B4 size in FIG. 4) and an outer edge of the electrically conductive film 22*b* located inside corresponds to the width of an image to be formed. That is, the adjacent electrically conductive films 22*a* and 22*b* are arranged so that the inner edge of the electrically conductive film 22*a* defines the width of the paper and the outer edge of the electrically conductive film 22*b* located inside defines the width of the image to be formed. Other pairs of electrically conductive films 22*b* and 22*c*, 22*c* and 22*d*, and so on, are also arranged in similar positional relationships.

Figure 11:
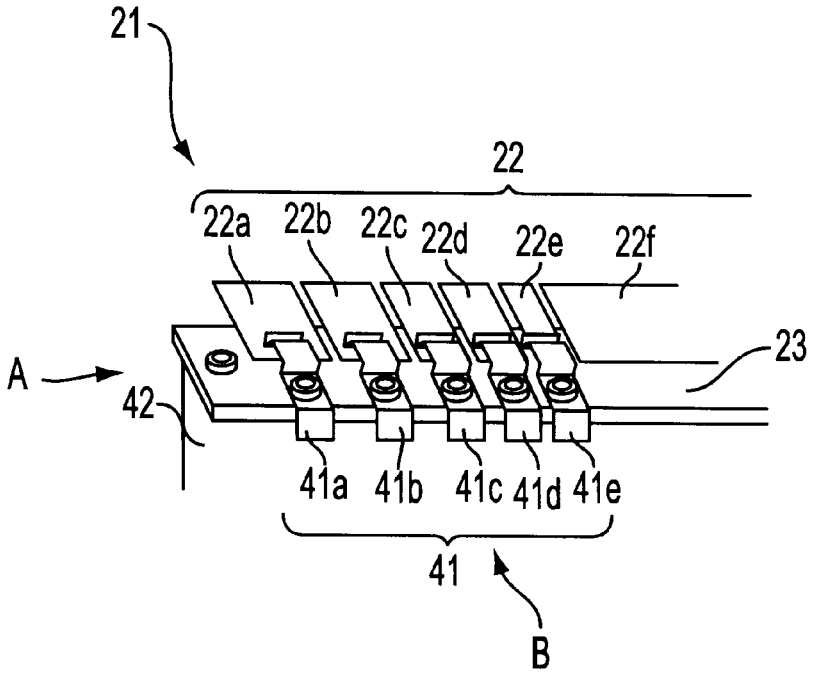
FIG. 11 shows the configuration of the belt grounding device including a mechanism for switching between grounded state and ungrounded state.
Figure 12:
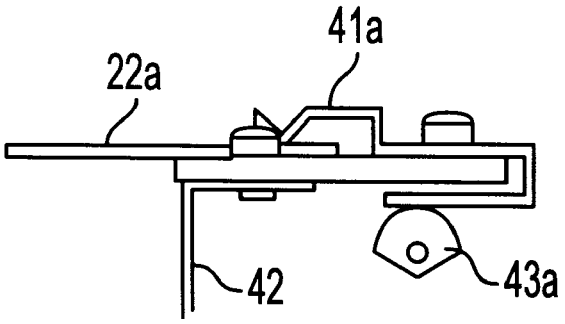
FIG. 12 is a view along direction A of FIG. 11, showing grounded state of the belt grounding device.
Figure 13:
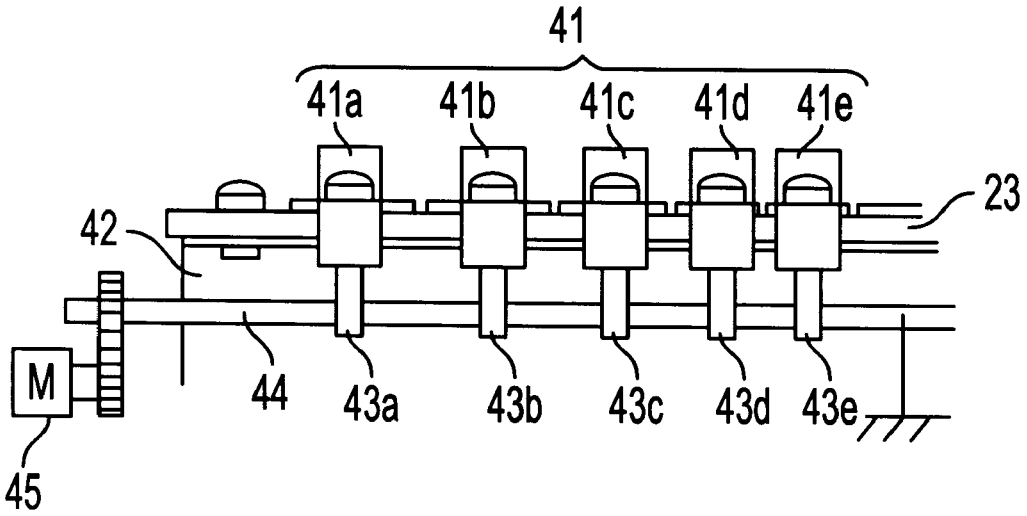
FIG. 13 is a view along direction B of FIG. 11.
Figure 14:
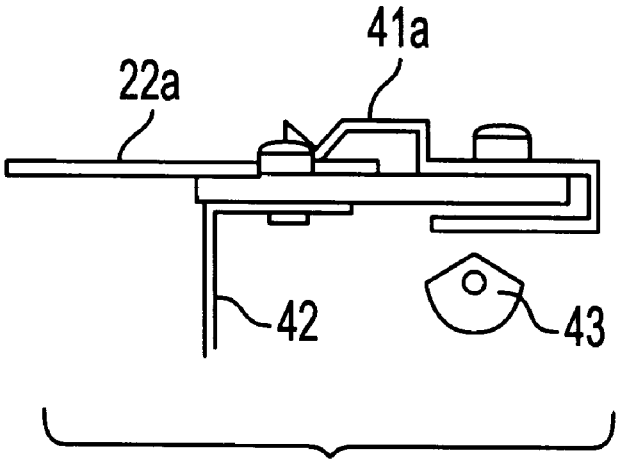
FIG. 14 shows ungrounded state of the belt grounding device.
Figure 15:
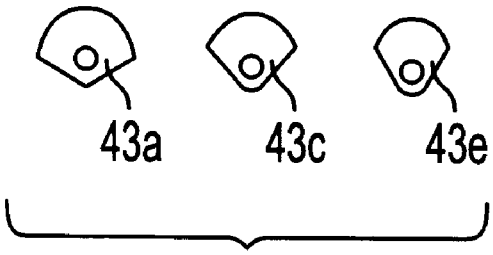
FIG. 15 shows the configuration of a cam.

In this embodiment, grounded state and ungrounded state of the electrically conductive film 22 is switched by means of a cam. Configuration of the belt grounding device 21 will be described below with reference to FIG. 11 through FIG. 14. FIG. 11 is a schematic diagram showing the configuration of the belt grounding device 21, and views in the directions of A and B in FIG. 11 are shown in FIG. 12 (FIG. 14) and FIG. 13. FIG. 15 shows the shape of the cam which switches between grounded state and ungrounded state of the electrically conductive film 22. FIG. 12 shows the electrically conductive film in grounded state and FIG. 14 shows the electrically conductive film in ungrounded state.

The electrically conductive film 22 in the belt grounding device 21 is bonded onto the holder 23 by means of a double-side adhesive tape, while the holder 23 is fastened onto an L-shaped bracket 42 with screws and the L-shaped bracket 42 is fastened onto a frame of the copying machine. Electrically conductive leaf springs 41*a* through 41*e* which are fastened onto the holder 23 with screws make contact with the electrically conductive films 22*a* through 22*e*, respectively. The leaf spring 41 has resilience in a portion which makes contact with the electrically conductive film 22, with other portion being kept in a constant shape. The reason for making the leaf spring 41 resilient in the portion which makes contact with the electrically conductive film 22 is to ensure reliable contact of the leaf spring 41 with the electrically conductive film 22. Installed below the leaf springs 41*a* through 41*e* are cams 43*a* through 43*e* made of a metal, respectively, while the cams 43*a* through 43*e* are fastened onto a metal shaft 44 through electrically conductive contact.

The metal shaft 44 is grounded to the earth, with one end thereof being connected to a motor 45 to be rotated thereby over a desired angle. Therefore, the cams 43*a* through 43*e* also rotate as the metal shaft 44 rotates. As the cams 43*a* through 43*e* rotate, the cams 43*a* through 43*e* and the leaf springs 41*a* through 41*e* make contact with each other or depart therefrom, respectively. Thus grounded state (FIG. 1) and ungrounded state (FIG. 14) of the electrically conductive film 22 can be switched by the cams 43*a* through 43*e*. Which of the electrically conductive films 22*a* through 22*e* should be grounded can be selected by changing the shapes of the cams 43*a* through 43*e*. Therefore according to this embodiment, the cams are made in such a configuration as shown in FIG. 15 that a cam located more inward (nearer to the center) makes contact with the leaf spring with smaller contact angle, and thus the electrically conductive films 22*a* through 22*e* can be selectively grounded according to the rotation angle of the metal shaft 44. When an A4 sheet is fed with the shorter side thereof in the feeding direction, for example, the motor 45 rotates the metal shaft 44 by an angle which has been determined in advance according to paper setting information, and the electrically conductive films 22*a* and 22*b* located outside the A4 sheet are grounded while the other electrically conductive films remain ungrounded. In the case of a B4 sheet, the motor 45 rotates the metal shaft 44 by an angle which has been determined in advance according to the paper setting information, and only the electrically conductive film 22*a* located outside the B4 sheet is grounded with other electrically conductive films remaining ungrounded. By forming an electric circuit for current bypass having a low impedance in a portion not occupied by the copy paper P during transfer operation as described above, such a phenomenon can be prevented from taking place as excessive current flows into the photosensitive drum 1 at the portion not occupied by the copy paper P.

Figure 16:
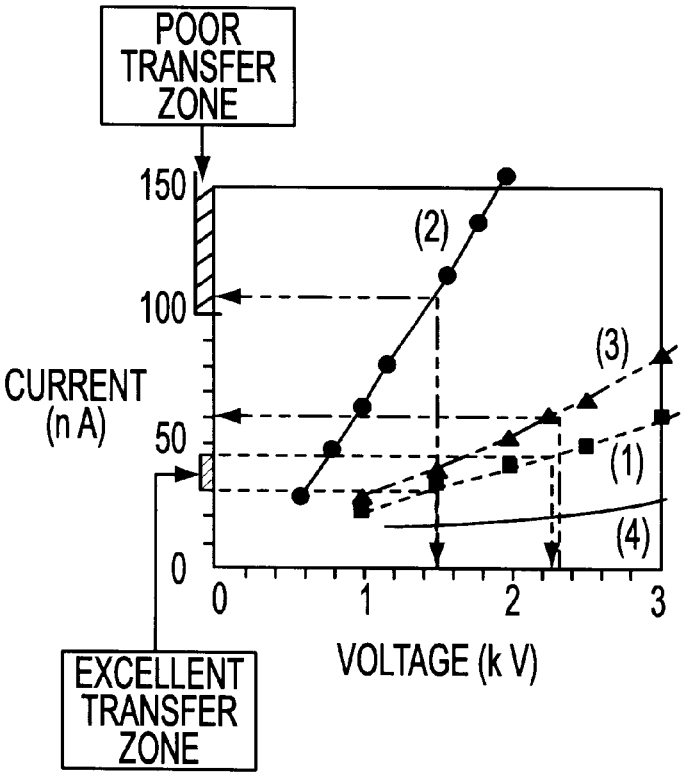
FIG. 16 is a graph showing the result of a test conducted to verify the effect of the invention.
Figure 17:
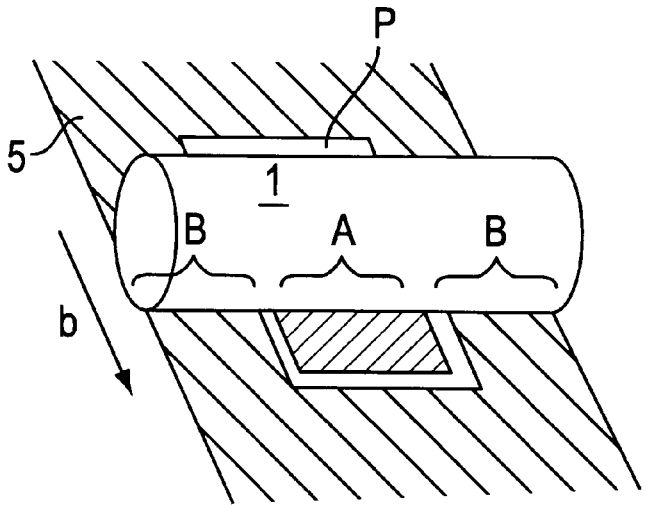
FIG. 17 shows a position where current was measured in a test conducted to verify the effect of the invention.
Figure 18:
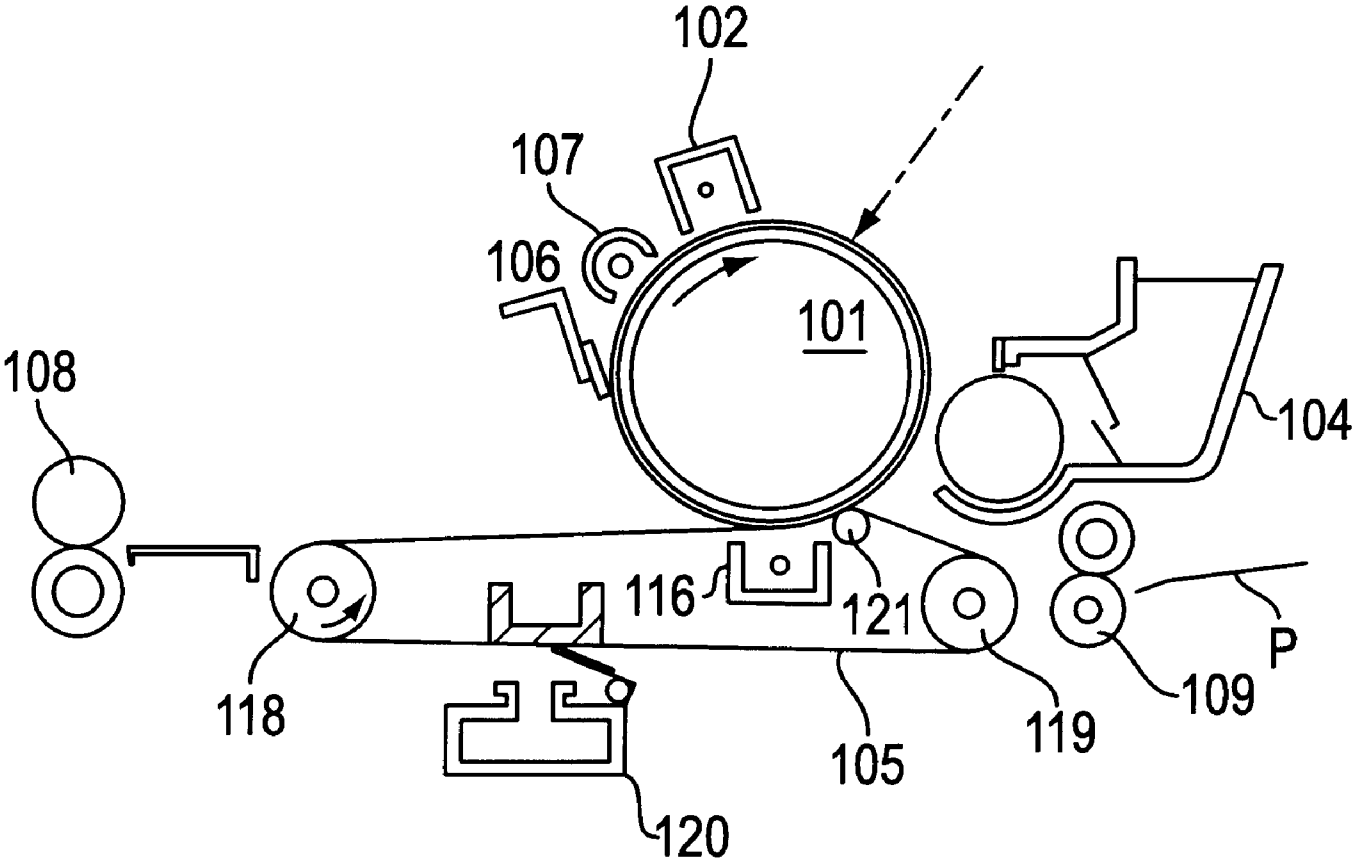
FIG. 18 is a schematic drawing showing the configuration of an image forming apparatus of the prior art.

For the purpose of verifying the effect of the belt grounding device 21, change in the current flowing into the photosensitive drum 1 was measured at the transfer section of the image forming apparatus shown in FIG. 1. Results of the measurement are shown in FIG. 16 and the points where the current was measured are shown in FIG. 17. In the graph shown in FIG. 16, voltage applied to the transfer brush 16 is plotted along the horizontal axis and the current flowing into the photosensitive drum 1 per 1 mm of distance in the direction of rotation of the photosensitive drum 1 is plotted along the vertical axis.

The measurement was made by using the transfer belt 5 made by dispersing carbon in a fluorine plastic material to have volume resistivity of $10^{10}\Omega\cdot$cm. The transfer brush 16 having resistance of $10^{6}\Omega$per 1 mm of distance in the direction of rotation of the photosensitive drum 1 was used, while the transfer brush 16 was brought into contact with the transfer belt 5 at a position 5 mm downstream from a position where the transfer belt 5 and the photosensitive drum 1 made contact with each other. The electrically conductive film 22 having resistance of $10^{5}\Omega$per 1 mm of distance in the direction of rotation of the photosensitive drum 1 was used in the belt grounding device 21, while the electrically conductive film 22 was brought into contact with the transfer belt 5 at a position just below the photosensitive drum 1. For the copy paper P used as the transfer material, plain copy paper weighing 64 g/m$^2$ was used, while the paper feeding speed was set to 160 mm/s.

Curve (1) in FIG. 16 shows the characteristic when the electrically conductive film is not grounded at the portion where the toner image is to be transferred to the copy paper P (portion A in FIG. 17). Curve (2) shows the characteristic when the electrically conductive film is not grounded at the portion where there are not the copy paper P and toner image (portion B in FIG. 17). Curve (3) shows the characteristic when the electrically conductive film is grounded at the portion where there are not copy paper P and toner image (portion B in FIG. 17). Curve (4) shows the characteristic when the electrically conductive film is grounded at both the portion where the toner image is to be transferred to the copy paper P (portion A in FIG. 17) and the portion where there are not copy paper P and toner image (portion B in FIG. 17). An image forming apparatus of the prior art without the pre-transfer roller 121 corresponds to curve (2) and an image forming apparatus of the prior art equipped with the pre-transfer roller 121 corresponds to curve (4).

In case the current flowing into the photosensitive drum 1 is small when transferring a toner image formed on the photosensitive drum 1 onto the copy paper P, image transfer electric field having a sufficient intensity to transfer the toner image cannot be generated and a low transfer efficiency results. In case an excessive current flows into the photosensitive drum 1, on the other hand, discharge occurs in and around the transfer section thus causing the electrostatic charge to move, and therefore image transfer electric field having a sufficient intensity to transfer the toner image cannot be generated and a low transfer efficiency results. Therefore, in order to achieve a good transfer efficiency, it is necessary to set the current flowing into the photosensitive drum 1 at the position of transferring the toner image onto the copy paper P within a proper range. In the present experiment, optimum current range was set from 30 to 42 nA, which is shown in FIG. 16 as a preferred transfer range.

Transfer memory occurs when an excessive current flows into the photosensitive drum 1 at the transfer section which causes the surface of the photosensitive drum 1 to be charged positively, resulting in a potential lower than the desired charge potential during the next image forming cycle. While the level of current flowing into the photosensitive drum 1 that causes transfer memory is determined by such factors as the potential of the photosensitive body, dielectric constant of a photosensitive layer, thickness of the photosensitive layer and charging capacity of the electrostatic charger, transfer memory occurred at 100 nA and higher current levels in the present experiment, with the range shown in FIG. 16 as a transfer memory causing range.

Investigation of a proper range of voltages applied to the transfer brush 16 for satisfactory image transfer leads to the following findings. That is, such a range of voltages is appropriate that a current in a range from 30 to 42 nA flows in the image forming section (portion A of FIG. 17) and a current of 100 nA or lower flows in a portion where the paper does not pass (portion B of FIG. 17). Therefore, in case the electrically conductive film 22 is not grounded (when the image forming section shows the characteristic of curve (1) and the portion where the paper does not pass shows the characteristic of curve (2) in FIG. 16), the range of applied voltages that satisfies the current conditions described above is from 1.5 to 2.3 kV from the curve (1) in the image forming section and 1.4 kV or lower from the curve (2) in the portion where the paper does not pass, thus there exists no proper range of applied voltages. When the voltage applied to the transfer brush 16 is set to, for example, 1.5 kV in such a case, image is transferred in a portion occupied by the copy paper P at an inflow current of 30 nA, but the inflow current becomes 110 nA in a portion not occupied by the copy paper P resulting in transfer memory, and a high-quality output image cannot be obtained.

In contrast, when the electrically conductive film 22 in the portion where paper does not pass (electrically conductive film 22*a* in the case of a B4 sheet) is grounded (when the image forming section shows the characteristic of curve (1) and the portion where the paper does not pass shows the characteristic of curve (3) in FIG. 16), the range of applied voltages that satisfies the current conditions described above is from 1.5 to 2.3 kV from the curve (1) in the image forming section and 3.2 kV or lower from the curve (3) in the portion where the paper does not pass, thus the proper range of applied voltages is from 1.5 to 2.3 kV. When the voltage applied to the transfer brush 16 is set to, for example, 1.5 kV in such a case, image is transferred at an inflow current of 30 nA in a portion occupied by the copy paper P and an inflow current of 35 nA in a portion not occupied by the copy paper P, thus a high-quality output image can be obtained without transfer memory taking place. While constant voltage control (control of applied voltage) is carried out in this case, it is a matter of course that constant current control (control of total current flowing into the photosensitive drum) can be done in which case, too, similar effect to that of the constant voltage control can be obtained.

According to the image forming apparatus of this embodiment, as described in detail above, as the belt grounding device 21 is provided while the belt grounding device 21 has the electrically conductive films 22 which, being divided in a configuration corresponding to the seize of the copy paper P, make contact with the transfer belt 16 and can be switched between grounded state and ungrounded state, only the portion not occupied by the transfer material during transferring operation can be surely grounded. Thus because excessive current can be prevented from flowing into the photosensitive drum 1 at a portion without the transfer material during transfer operation, the desired potential of the photosensitive body can be achieved during the next image forming cycle, and therefore transfer memory does not occur and high-quality output image can be obtained.

It will be appreciated that the present invention is not restricted to the embodiment described above, and embraces various improvements and modifications made thereto within the scope of the spirit thereof. For example, while the electrically conductive films 22*a* through 22*e* are mechanically switched between grounded state and ungrounded state by using the cams 44*a* through 44*e* and the motor 45, though the switching can also be done electrically by incorporating an electrical circuit. The belt grounding device 21 may also be made in such a configuration as a roller.

According to the image forming apparatus of the present invention, as described above, because the image forming apparatus has the electrically conductive members which make contact with the transfer material carrier and has selector switches capable of switching between grounded state and ungrounded state, only the portion not occupied by the transfer material during transferring operation can be grounded. Thus because excessive current can be prevented from flowing into the image carrier at a portion not occupied by the transfer material during transfer operation, the desired potential of the image carrier (photosensitive body) can be achieved during the next image forming cycle, transfer memory does not occur and high-quality output image can be obtained. Further, when the selector switch is made in such a configuration that is capable of switching between grounded state and ungrounded state according to the size of the transfer material, only the portion without the transfer material during transferring operation can be surely grounded. Thus it is made possible to prevent transfer memory from occurring more accurately and obtain output images of higher quality.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus comprising:

an image carrier which holds a toner image;

a transfer material carrier which carries a transfer material to a transferring position;

an image transfer electric field forming means which forms, at said transferring position, an image transfer electric field for transferring the toner image held on said imager carrier onto said transfer material;

an electrically conductive member which makes contact with said transfer material carrier and is capable of switching between grounded state and ungrounded state, said electrically conductive member comprising a plurality of pieces divided in the direction of width of said transfer material carrier; and a switching device which switches between grounded state and ungrounded state of the electrically conductive member.

2. The image forming apparatus as claimed in claim 1, wherein said pieces are held while being insulated from each other.

3. The image forming apparatus as claimed in claim 1, wherein a selector switch for switching between grounded state and ungrounded state of said electrically conductive member is provided for each of said pieces.

4. The image forming apparatus as claimed in claim 3, wherein said selector switch is switched according to the size of said transfer material, thereby grounding only a portion not occupied by the transfer material.

5. The image forming apparatus as claimed in claim 1, wherein a position where said electrically conductive member makes contact with the transfer material carrier is located between the position of said image transfer electric field forming means and said transferring position.

6. The image forming apparatus as claimed in claim 1, wherein an image transfer electric field forming device consists of a contact transfer device selected from among fixed brush, rotary brush, elastic roller and elastic blade, which makes contact with said transfer material carrier with a voltage of such a polarity as the toner image is transferred being applied thereto.

7. The image forming apparatus as claimed in claim 1, wherein the electrically conductive member comprises a plurality of electrically conductive films divided in the direction of width of said transfer material carrier bonded onto an insulating holder made of a resin.

8. The image forming apparatus as claimed in claim 7, wherein the plurality of electrically conductive films are urged by leaf springs.

9. The image forming apparatus as claimed in claim 1, wherein the switching device comprises:

cams connected to the electrically conductive members;

a rotary shaft engaged with the cams; and a drive device which drives the shaft to make a predetermined number of revolutions.

10. The image forming apparatus as claimed in claim 1, wherein the switching device switches the electrically conductive member between grounded state and ungrounded state according to the size of the transfer material which is moved to the transferring position.

11. A transfer device for transferring a toner image held by an image carrier onto a transfer material comprising:

an image transfer electric field forming device which forms an electric field for attracting the toner image held by the image carrier onto the transfer material;

an electrically conductive member which is in contact with said transfer material carrier and is capable of switching between grounded state and ungrounded state, said electrically conductive member comprising a plurality of pieces divided in the direction of width of the transfer material carrier; and a switching device for switching the electrically conductive member between grounded state and ungrounded state.

12. The image forming apparatus as claimed in claim 11, wherein said pieces are held while being insulated from each other.

13. The image forming apparatus as claimed in claim 11, wherein a selector switch is provided for each of said pieces for switching the electrically conductive member between grounded state and ungrounded state.

14. The image forming apparatus as claimed in claim 13, wherein said selector switch is switched according to the size of said transfer material, thereby grounding only a portion not occupied by the transfer material.

15. The image forming apparatus as claimed in claim 11, wherein a position where said electrically conductive member makes contact with the transfer material carrier is located between the position of said image transfer field forming means and said transferring position.

16. The image forming apparatus as claimed in claim 11, wherein the electrically conductive member comprises a plurality of electrically conductive films divided in the direction of width of said transfer material carrier bonded onto an insulating holder made of a resin.

17. The image forming apparatus as claimed in claim 11, wherein the switching device comprises:

cams connected to the electrically conductive members;

a rotary shaft engaged with the cams; and a drive device for driving the shaft to make a predetermined number of revolutions.

18. An image forming apparatus comprising:

an image carrier which holds a toner image;

a transfer material carrier which carries a transfer material to a transferring position;

an image transfer electric field forming device which forms, at said transferring position, an image transfer electric field for transferring the toner image held on said imager carrier onto said transfer material;

an electrically conductive member which makes contact with said transfer material carrier and is capable of switching between grounded state and ungrounded state, the electrically conductive member comprising a plurality of pieces divided in the direction of width of the transfer material carrier;

a detecting device for detecting the size of the transfer material; and a switching device which switches the electrically conductive member between grounded state and ungrounded state.

19. The image forming apparatus as claimed in claim 18, wherein said pieces are held while being insulated from each other.

20. The image forming apparatus as claimed in claim 18, wherein a selector switch is provided for each of said pieces for switching the electrically conductive member between grounded state and ungrounded state.

21. The image forming apparatus as claimed in claim 18, wherein said selector switch is switched according to the size of said transfer material, thereby grounding only a portion not occupied by the transfer material.

22. The image forming apparatus as claimed in claim 18, wherein a position where said electrically conductive member makes contact with the transfer material carrier is located between the position of said image transfer electric field forming means and said transferring position.

23. An image forming method comprising:

a step of holding a toner image on an image carrier;

a step of carrying a transfer material to a transferring position;

a step of forming an image transfer electric field at said transferring position for transferring the toner image held on said image carrier onto said transfer material;

a step for detecting the size of the transfer material; and a step of switching the electrically conductive member between grounded state and ungrounded state according to the result of detection by the detecting device, wherein the electrically conductive member comprises a plurality of pieces divided in the direction of width of the transfer material carrier.

* * * * *